US007232194B2

(12) United States Patent
Becke et al.

(10) Patent No.: US 7,232,194 B2
(45) Date of Patent: Jun. 19, 2007

(54) INSERT FOR A DOOR STORAGE COMPARTMENT

(75) Inventors: Christoph Becke, Grosskarolinenfeld (DE); Silvia Gerstner, Langenau (DE); Siegfried Grasy, Dornstadt (DE); Michael Kordon, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/816,372

(22) Filed: Apr. 1, 2004

(65) Prior Publication Data

US 2004/0183416 A1 Sep. 23, 2004

Related U.S. Application Data

(63) Continuation of application No. PCT/EP02/10752, filed on Sep. 25, 2002.

(30) Foreign Application Priority Data

Oct. 1, 2002 (DE) ..... 101 48 406

(51) Int. Cl.
*A47F 5/00* (2006.01)

(52) U.S. Cl. ..... 312/321.5; 312/405.1; 211/71.01

(58) Field of Classification Search ..... 312/405.1, 312/321.5; 211/88.01, 71.01, 75, 74, 119.003
See application file for complete search history.

(56) References Cited

U.S. PATENT DOCUMENTS 1,615,571 A * 1/1927 Crecelius ..... 248/108
1,666,652 A * 4/1928 Hiering ..... 220/324
2,697,258 A * 12/1954 Uyal ..... 24/10 R
2,995,256 A * 8/1961 Schoenfisch ..... 211/70.6
3,702,671 A * 11/1972 Cirillo ..... 224/242
4,189,048 A * 2/1980 Gaillard ..... 206/37
D271,903 S * 12/1983 Kaufman ..... D24/229
4,613,068 A * 9/1986 Bianchi ..... 224/242
4,775,052 A * 10/1988 Moore et al. ..... 211/4
5,330,261 A * 7/1994 Bennett ..... 312/321.5
5,358,128 A * 10/1994 Belokin et al. ..... 211/75
5,673,801 A * 10/1997 Markson ..... 211/59.3
5,785,188 A * 7/1998 Ogden ..... 211/88.01
D402,840 S * 12/1998 Servis ..... D6/553
5,913,433 A * 6/1999 Belokin et al. ..... 211/90.01
5,950,833 A * 9/1999 James ..... 206/522
D442,405 S * 5/2001 Gerstmar ..... D6/515
6,571,967 B2 * 6/2003 Belokin et al. ..... 211/71.01
D482,255 S * 11/2003 Winig et al. ..... D8/71
2005/0284867 A1 * 12/2005 Sander et al. ..... 220/23.86

FOREIGN PATENT DOCUMENTS

DE 86 32 853.0 U1 3/1987
DE 90 14 463.5 U1 2/1991
DE 43 04 502 A1 8/1994
EP 0 611 930 A2 8/1994
EP 1 030 140 A2 8/2000
JP 2000065466 A 3/2000
JP 2001074359 A 3/2001

* cited by examiner

*Primary Examiner*—Janet M. Wilkens
(74) *Attorney, Agent, or Firm*—Russell W. Warnock; Craig J. Loest

(57) ABSTRACT

An insert is provided for a door storage compartment. The insert contains a frame that forms at least one chamber and has a fixing device located on one side of the frame for fixing the insert to the door storage compartment. A second side of the frame contains at least one indentation for securing an object that lies outside of the frame.

12 Claims, 2 Drawing Sheets

INSERT FOR A DOOR STORAGE COMPARTMENT

CROSS-REFERENCE TO RELATED APPLICATION

This application is a continuation, under 35 U.S.C. § 120, of copending international application No. PCT/EP02/10752, filed Sep. 25, 2002, which designated the United States; this application also claims the priority, under 35 U.S.C. § 119, of German patent application No. 101 48 406.2, filed Oct. 1, 2001; the prior applications are herewith incorporated by reference in their entirety.

BACKGROUND OF THE INVENTION

Field of the Invention

The present invention relates to an insert which is intended to be used on a door storage compartment of the type which is normally installed on the inner wall of the door of a domestic refrigerator.

Door storage compartments such as these are known from German Utility Model DE 90 14 463. They are essentially in the form of a box with an open top, and are generally used in order to accommodate small items such as tubes, small bottles, fresh spices etc., which run the risk of being concealed by larger objects stored in the front of the compartments of the interior of the refrigerator, and then the small items being difficult to find again. By virtue of their shape, many of these small parts are not suitable for being located in a space-saving, clearly visible manner. If they are located in an unorganized manner in the door storage compartments, the individual parts are once again difficult to find, which on the one hand is inconvenient for the user owing to the time loss associated with searching for them, but on the other hand also leads to severe heating of the interior of the refrigerator, and thus to increased energy consumption, because the door necessarily has to be open while searching for them.

SUMMARY OF THE INVENTION

It is accordingly an object of the invention to provide an insert for a door storage compartment which overcomes the above-mentioned disadvantages of the prior art devices of this general type, which is of simple design, costs little and allows a large number of small items of different shapes to be stored in a clearly visible manner.

With the foregoing and other objects in view there is provided, in accordance with the invention, an insert for a door storage compartment. The insert contains a frame forming at least one chamber and has a first side and an attachment device disposed at the first side. The attachment device is provided for attaching to the door storage compartment. The frame has a second side with at least one indentation for fixing an object located outside of the frame.

The object is achieved by the insert for a door storage compartment, having a frame that forms at least one chamber and has an attachment device, which is disposed at one side of the frame, for attachment to the door storage compartment. A second side of the frame has at least one indentation which is able to fix an object which is located outside the frame, by interaction with an opposite side wall of the door storage compartment. The insert thus not only allows objects to be held in a clearly visible manner within the frame, but also outside it.

The frame is preferably flexible, at least in the area of the second side, so that objects which are slightly larger than the space which is available when the insert is in the unstressed state can be inserted into the frame or else into the space between the second side and the opposite wall of the door storage compartment, and are held clamped in firmly by elastic deformation of the frame.

It is also preferable for the insert to be rigid at least in the area of a third side, which is oriented transversely with respect to the first side. If the first side is disposed on a longitudinal side of the door storage compartment, this allows the insert to be attached to the longitudinal side in a position such that, for example, a bottle is clamped in between the longitudinal end of the door storage compartment and the third side, or at least its freedom of movement is restricted sufficiently that it cannot fall over.

The frame preferably forms at least two chambers, which are separated from one another by a web that is connected to only one of the two sides. This in each case allows an object to be placed in each of the chambers but does not adversely affect the capability of the frame to deform and thus does not impede a further object being clamped between the frame and the opposite side of the door storage compartment in the area of the indentation.

The web is preferably not connected to the first side. In this case, the risk of the web being displaced laterally when it strikes the second side is less than in the opposite case, which is also feasible, of a web which is connected to the first side and strikes the convex inner face of the indentation on deformation.

The web should be connected to the indentation in the second side, in the interest of making good use of the space in the frame.

The web should be of such a length that an unconnected end of the web can be brought into contact with an opposite side of the frame by reversible elastic deformation of the frame. With this configuration, the resistance of the frame to deformation increases suddenly as soon as the web comes into contact with the first side, thus avoiding excessive deformation of the frame, which could lead to damage.

As further protection against damage, it is possible to provide for the web to have a greater wall thickness than other parts of the frame and thus to provide considerable resistance to excessive deformation of the frame.

The deformation capability of the frame is also assisted if the insert is open at the bottom, at least in the vicinity of each web.

In order to allow objects of different size to be held in an upright position as clearly visibly as possible and in a space-saving manner, the frame preferably has chambers of different size.

Other features which are considered as characteristic for the invention are set forth in the appended claims.

Although the invention is illustrated and described herein as embodied in an insert for a door storage compartment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
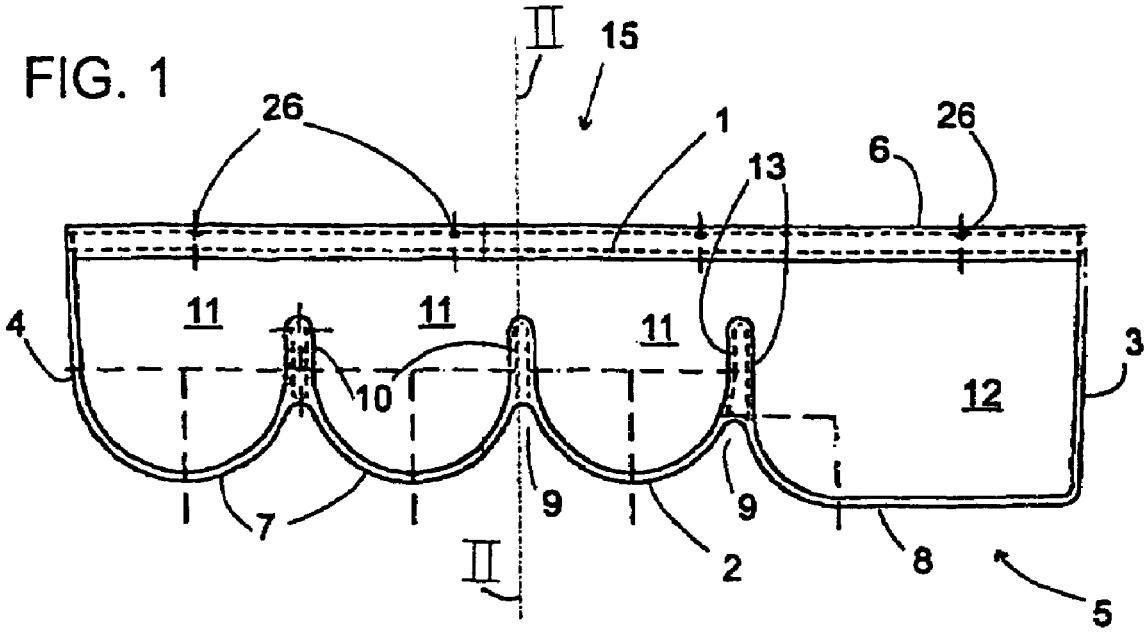
FIG. 1 is a diagrammatic, plan view of an insert for a door storage compartment according to the invention.

Referring now to the figures of the drawing in detail and first, particularly, to FIG. 1 thereof, there is shown a plan view of an insert 15 for a door storage compartment of a refrigerator door. The insert 15 contains a frame 5 with a roughly approximately rectangular shape and with four side walls 1, 2, 3, 4, and an elongated latching hook 6 which extends along one of the side walls 1 and is intended for attachment of the insert to the door storage compartment by being plugged onto a side wall of the door storage compartment.

The second side wall 2, which is opposite the first side wall 1, is subdivided into two or more semicircular sections 7 and a section 8 with a partially linear wall profile. The semicircular sections 7 and the section 8 are each adjacent to indentations 9 in the side wall 2. On each indentation 9 between two sections 7 or 8, a web 10 extends into the interior of the frame 5, in order to subdivide it into two or more chambers 11, 12 of different size. The individual chambers 11, 12 have no bottom, and the webs 10 do not reach the opposite side wall 1, provided that the frame 5 is not deformed in contact with the items being stored.

Figure 2:
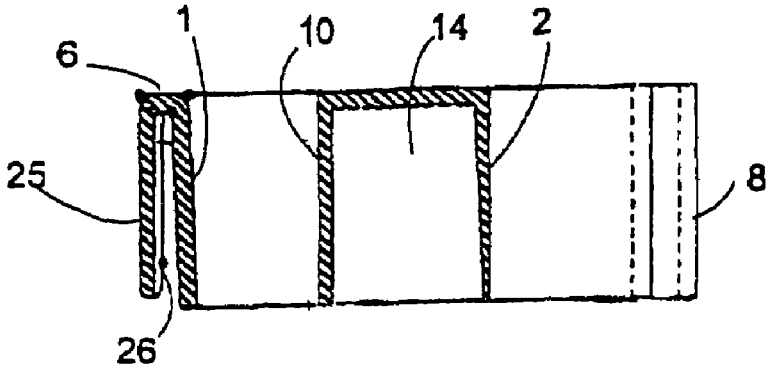
FIG. 2 is a vertical sectional view through the insert shown in FIG. 1, and taken along the line II—II shown in FIG. 1.

FIG. 2 shows a section through the insert 15 illustrated in FIG. 1, taken along the line II—II in FIG. 1, at the level of its web 10. This section shows, in particular, the structure of the latching hook 6 with a vertical plate or tongue 25, whose extent is approximately the same as that of the side wall 1 which is opposite and parallel to it and is used to clamp in a side wall of the door storage compartment to which the insert is fitted. Two or more vertical ribs 26 are formed on the surface of the plate 25 facing the side wall 1, clamp in one side wall of the door storage compartment between them and the wall 1, and thus secure the insert against being displaced laterally.

FIG. 2 also shows the double-walled structure of the webs 10, between whose two parallel side walls 13, whose wall thickness corresponds approximately to that of the side walls 1 to 4, a cavity 14 is located, which is open at the bottom.

Figure 3:
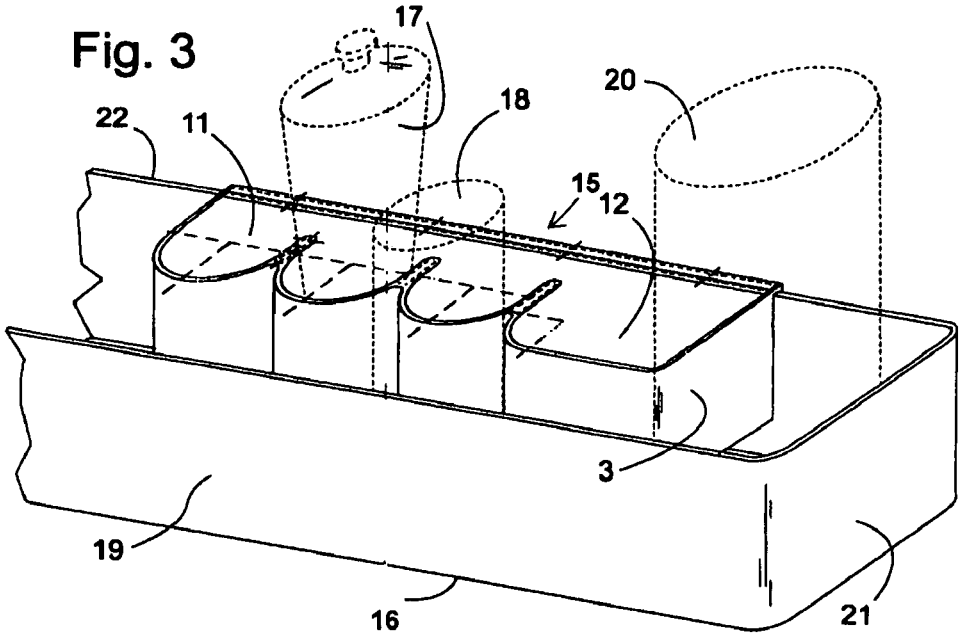
FIG. 3 is a perspective view of a door storage compartment for a refrigerator with an insert according to the invention.

FIG. 3 shows a perspective view of the insert 15 as shown in FIGS. 1 and 2, fitted to a door storage compartment 16. Each of the chambers 11, 12 is used to hold a small item, such as a tube 17, that is shown by dashed lines in FIG. 3. Further small items such as a can 18, which is likewise illustrated by dashed lines, may be disposed between the second side wall 2 of the frame and an opposite, front side wall 19 of the door storage compartment 16, and are secured against falling over by their engagement in one of the indentations 9.

Another container, illustrated as a dashed can 20, which is too large to fit in one of the chambers 11, 12 or into the space between the side wall 2 and the front wall 19 of the door storage compartment 16, can be secured between an end wall 21 of the door storage compartment 16 and a third, short side wall 3 of the frame, such that it cannot fall over in the lateral direction of the door storage compartment 16. In order to allow effective protection against tilting for an object such as the can 20 between the frame 5 and the end wall 21, the latching hook 25 and/or the side wall 1 opposite it are/is provided with a non-illustrated latching tooth systems, which engage with a complementary non-illustrated latching tooth system on a rear wall 22 of the door storage compartment 16 and prevent undesirable lateral sliding of the insert.

Figure 4:
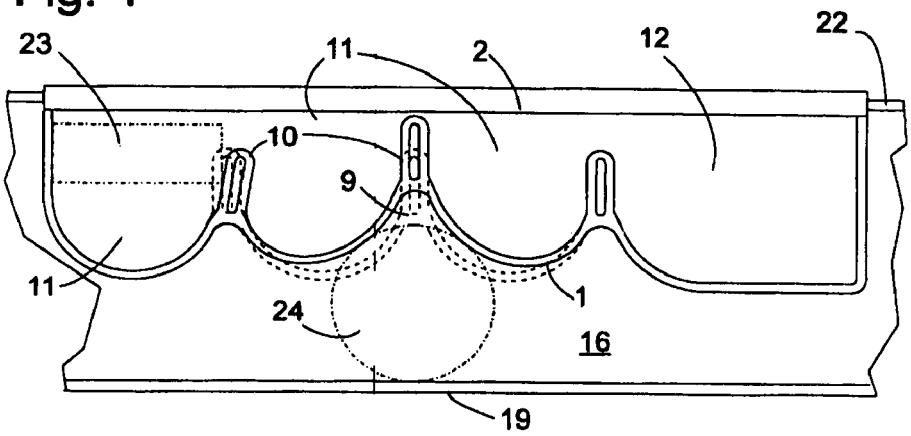
FIG. 4 is a plan view illustrating a method of operation of the insert.

Since the frame 5 is elastic at least in the area of the second side wall 2, the chambers 11, 12 can be deformed to a certain extent, as is illustrated in FIG. 4, in order to hold and to fix objects which could not be accommodated in a rigid insert owing to their dimensions. For example, the left-hand chamber 11 of the insert 15 which is shown in FIG. 4 thus holds a box 23 which is slightly broader than the chamber 11 by the box 23 tilting the web 10 (which bounds the chamber) somewhat from its rest position, and forcing it into the adjacent chamber 11.

Objects such as a bottle 24 whose dimensions are slightly larger than those of the intermediate space can also and in particular be conveniently accommodated in the space between the second side wall 2 of the insert 15 and the front wall 19 of the door storage compartment 16 opposite the second side wall 2. For this purpose, the side wall 2 is forced back elastically against the opposite side wall 1 in the area of that indentation 9 which is intended to hold the object. From this position, the side wall 2 exerts an elastic clamping force on the bottle 24, which holds the bottle 24 pressed against the front wall 19 of the door storage compartment, and thus fixes it in its position.

In order to avoid excessive deformation of the side wall 2 as a result of an attempt to accommodate an excessively large object in the space between the side wall 2 and the front wall 19, the webs 10 are of such a size that they abut against the second side wall 1 before the elastic limit of the frame 5 is exceeded. Owing to their double-walled structure, the webs 10 have a wall thickness that is approximately twice as great as that of the side wall 2 from which they originate. They thus have considerable resistance to compression and are suitable for preventing damage to the frame 5 as a result of irregular use, in particular as a result of an attempt to insert excessively large containers between the side wall 2 and the front wall 19.

We claim:

1. An insert for a door storage compartment, the insert comprising:

a frame enclosing at least one chamber and having a first side and an attachment device disposed at said first side, said attachment device provided for attaching to the door storage compartment, said frame having a second side with at least one indentation formed therein for fixing an object located outside of said frame, wherein said frame is flexible and elastic, at least in an area of said second side; and wherein said frame forms at least two chambers; and further comprising a web separating said two chambers from one another, and said web is connected to only one of said first and second sides.

2. The insert according to claim 1, wherein said second side is disposed opposite said first side.

3. The insert according to claim 1, wherein said frame has a third side and is rigid at least in an area of said third side, said third side oriented transversely with respect to said first side.

4. The insert according to claim 1, wherein said web has an unconnected end which is not connected to said first side.

5. The insert according to claim 4, wherein said web is connected to said indentation formed in said second side.

6. The insert according to claim 1, wherein said frame has a bottom and is open at said bottom, at least in a vicinity of said web.

7. The insert according to claim 1, wherein said frame forms chambers of different sizes.

8. An insert for a door storage compartment, the insert comprising:

a frame enclosing at least two chambers and having a first side and an attachment device disposed at said first side, said attachment device provided for attaching to the door storage compartment, said frame having a second side with at least one indentation formed therein for fixing an object located outside said frame; and a web separating said two chambers from one another, with said web connected to only one of said first and second sides, said web having an unconnected end which is not connected to said first side, and wherein said unconnected end of said web can be brought into contact with said first side by reversible elastic deformation of said frame.

9. The insert according to claim 8, wherein said web has a greater wall thickness than said frame.

10. The insert according to claim 8, wherein said web is connected to said indentation formed in said second side.

11. The insert according to claim 8, wherein said frame has a bottom and is open at said bottom, at least in a vicinity of said web.

12. The insert according to claim 8, wherein said frame forms chambers of different sizes.

* * * * *